US005690073A

United States Patent [19]

Fuwa

[11] Patent Number: 5,690,073

[45] Date of Patent: Nov. 25, 1997

[54] FUEL INJECTION CONTROL DEVICE OF A MULTI-CYLINDER ENGINE

[75] Inventor: Naohide Fuwa, Susono, Japan

[73] Assignee: Toyota Jidosha Kabushiki Kaisha, Aichi, Japan

[21] Appl. No.: 658,550

[22] Filed: Jun. 5, 1996

[30] Foreign Application Priority Data

Jun. 9, 1995 [JP] Japan ..... 7-143308

[51] Int. Cl.[6] ..... F02D 41/06; F02D 41/36

[52] U.S. Cl. ..... 123/443; 123/481; 123/491

[58] Field of Search ..... 123/490, 491, 123/481, 443

[56] References Cited

U.S. PATENT DOCUMENTS

| | | | |
|---|---|---|---|
| 3,923,031 | 12/1975 | Keranen | 123/491 |
| 4,007,590 | 2/1977 | Nagai et al. | 123/481 |
| 4,998,522 | 3/1991 | Achleitner | 123/491 |
| 5,249,560 | 10/1993 | Gian et al. | 123/443 |

FOREIGN PATENT DOCUMENTS

| | | |
|---|---|---|
| 58-130079 | 9/1983 | Japan . |
| 2-19627 | 1/1990 | Japan . |
| 3-15636 | 1/1991 | Japan . |
| 4-303145 | 10/1992 | Japan . |
| 6-117299 | 4/1994 | Japan . |

*Primary Examiner*—Andrew M. Dolinar
*Attorney, Agent, or Firm*—Oliff & Berridge

[57] ABSTRACT

A fuel injection control device of a multi-cylinder engine in which fuel injection into selected cylinders stops or reduces during the engine startup period from the commencement of cranking to when the startup of the engine is completed. The cylinder(s) for which the fuel injection should be stopped or reduced is determined in accordance with the ease with which the engine is started as indicated by at least one condition or state of the engine.

13 Claims, 6 Drawing Sheets

Fig. 4

| WATER TEMPERATURE | INJECTION PATTERN | ORDER OF INJECTION TIMING | | | | | | | |
|---|---|---|---|---|---|---|---|---|---|
| | | 1 | 2 | 3 | 4 | 5 | 6 | 7 | 8 |
| LOW ← | A | ○ | ○ | ○ | ○ | ○ | ○ | ○ | ○ |
| | B | ○ | ○ | ○ | ○ | ○ | ○ | ○ | × |
| | C | ○ | ○ | ○ | ○ | ○ | × | ○ | × |
| | D | ○ | ○ | ○ | × | ○ | × | ○ | × |
| → | E | ○ | ○ | × | ○ | × | ○ | × | × |
| HIGH | F | ○ | × | ○ | × | × | ○ | × | × |

FUEL INJECTION CONTROL DEVICE OF A MULTI-CYLINDER ENGINE

BACKGROUND OF THE INVENTION

1. Field of the Invention

The present invention relates to a fuel injection control device of a multi-cylinder engine.

2. Description of the Related Art

When an air-fuel mixture is supplied to a cylinder positioned in the middle of an intake stroke at the startup of the engine, the air-fuel mixture is diluted by the air already existing in the cylinder. As a result, the air-fuel ratio becomes lean, causes misfiring and increases the amount of hydrocarbons in the exhaust. A multi-cylinder engine that does not inject fuel into a cylinder that is positioned in the middle of the intake stroke at the startup of the engine is well known (refer to Japanese Unexamined Patent Publication (Kokai) No. 6-117299).

During startup of an engine, an ignitable air-fuel mixture cannot be formed in a combustion chamber unless a large amount of fuel is supplied. Accordingly, during the period from the start of the cranking to when the startup of the engine is completed, a large amount of fuel is successively injected into the cylinders. If a large amount of fuel is supplied into the combustion chambers in this way, however, a large amount of unburned hydrocarbons is discharged from the engine. Accordingly, during the period from when the cranking is commenced to when the startup of the engine is completed, if a large amount of fuel is successively injected to the cylinders, the total amount of unburned HC discharged becomes extremely large.

During a study conducted by the present inventors, it became clear that in order to start the engine, it is not always necessary to successively inject a large amount of fuel to the cylinders and that the engine starts even if the fuel injection to some of the cylinders is reduced or stopped during the startup of the engine. If the fuel injection to some of the cylinders is reduced or stopped during the startup of the engine in this way, the total amount of the unburned HC discharged at the startup of the engine is greatly reduced.

Note that, as mentioned before, in the engine disclosed in Japanese Unexamined Patent Publication (Kokai) No. 6-117299, the fuel injection was stopped for the cylinder that is positioned in the middle of the intake stroke at the startup of the engine in order to prevent the occurrence of a misfire. However, it is not the object of the present invention to block the occurrence of misfiring. Further, in the present invention, unlike the related art disclosed in this publication, irrespective of whether or not a cylinder is positioned in the middle of the intake stroke, i.e., in other words, irrespective of the piston position in the engine, the fuel injected into some of the cylinders is stopped during the startup of the engine. Accordingly, this publication never suggested the present invention.

SUMMARY OF THE INVENTION

An object of the present invention is to provide a fuel injection control device capable of reducing the total amount of unburned HC discharged from the engine when the engine is starting.

According to the present invention, a fuel injection device is provided that senses at least one condition or state of an engine that affects the ease with which the engine is started and determines a fuel injection startup pattern that injects a full amount of fuel into at least one of a first cylinder and that injects a reduced amount of fuel into at least one of a second cylinder. The startup pattern reduces the ratio of second cylinders to first cylinders as the at least one condition or state indicates that the engine is easier to start.

BRIEF DESCRIPTION OF DRAWINGS

The present invention may be more fully understood from the description of preferred embodiments of the invention set forth below, together with the accompanying drawings, in which:

FIG. 4 is a view of an injection pattern;

DESCRIPTION OF THE PREFERRED EMBODIMENTS

Figure 1:
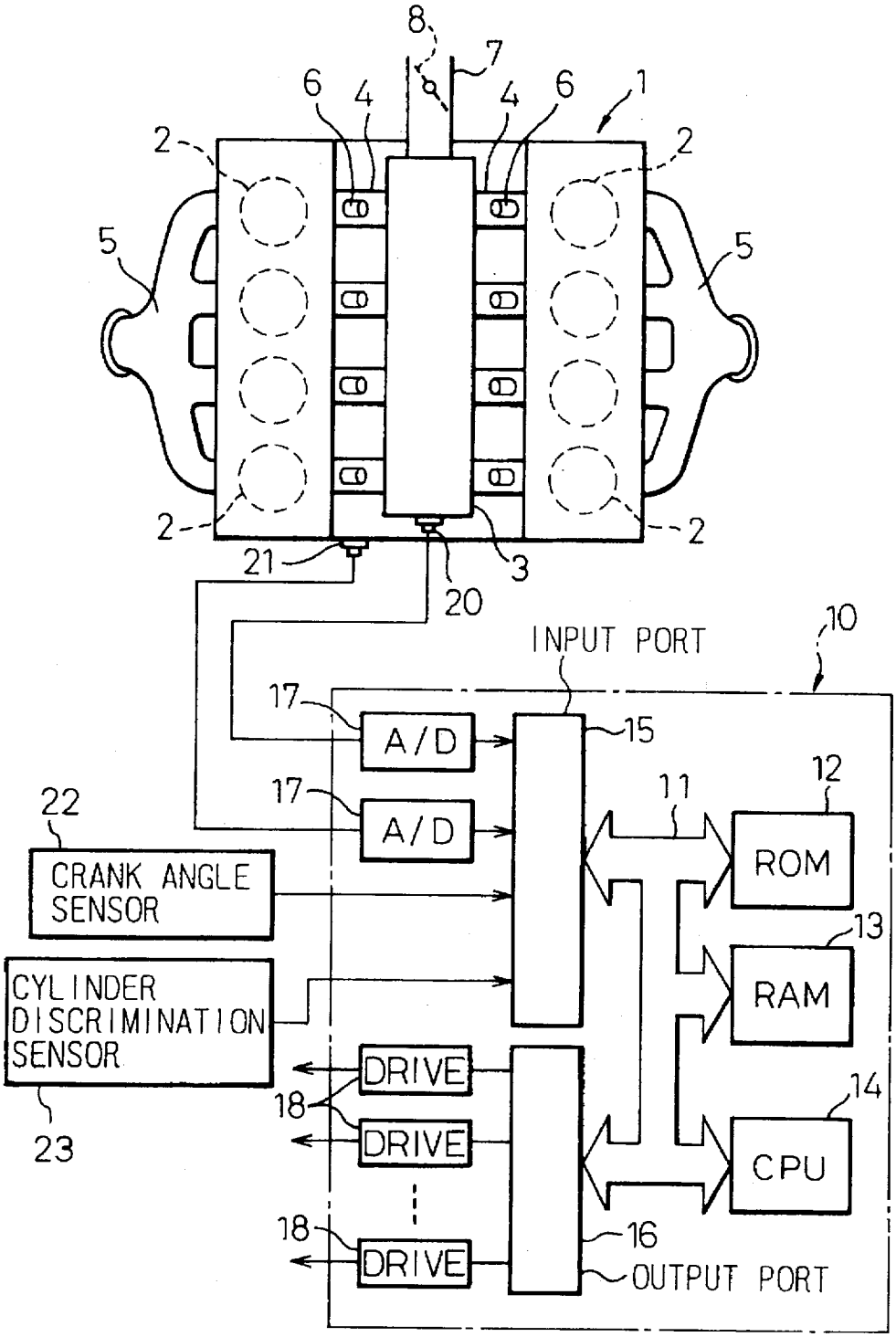
FIG. 1 is an overall view of an 8-cylinder V-engine.

Referring to FIG. 1, 1 is an 8-cylinder V-engine provided with eight cylinders 2; 3 a surge tank common to all cylinders; 4 an intake branch pipe connecting the surge tank 3 and the cylinders; and 5 a pair of exhaust manifolds. Fuel injectors 6 are individually attached to the intake branch pipes 4. The fuel is injected from the fuel injectors 6 toward the interior of the corresponding cylinders. The surge tank 3 is connected to an air cleaner (not illustrated) via an intake duct 7, and a throttle valve 8 is arranged in this intake duct 7.

An electronic control unit 10 comprises a digital computer and is provided with a read only memory (ROM) 12, a random access memory (RAM) 13, a microprocessor (CPU) 14, an input port 15, and an output port 16 which are mutually connected by a bidirectional bus 11. To the surge tank 3, a pressure sensor 20 generating an output voltage proportional to the absolute pressure in the surge tank 3 is attached. The output voltage of this pressure sensor 20 is input via a corresponding analog-to-digital (AD) converter 17 to the input port 15. Further, a water temperature sensor 21 generating an output voltage proportional to the engine cooling water temperature is attached to the engine 1. The output voltage of this water temperature sensor 21 is input via the corresponding AD converter 17 to the input port 15.

On the other hand, the input port 15 has connected to it a crank angle sensor 22 generating an output pulse whenever for example the crank angle rotates by 30 degrees and a cylinder discriminating sensor 23 detecting when one of the cylinders is located at for example the top dead center during the intake stroke. The engine speed is calculated based on the output pulse of the crank angle sensor 22. On the other hand, the output port 16 is connected via the drive circuits 18 to the corresponding fuel injectors 6.

Figure 2:
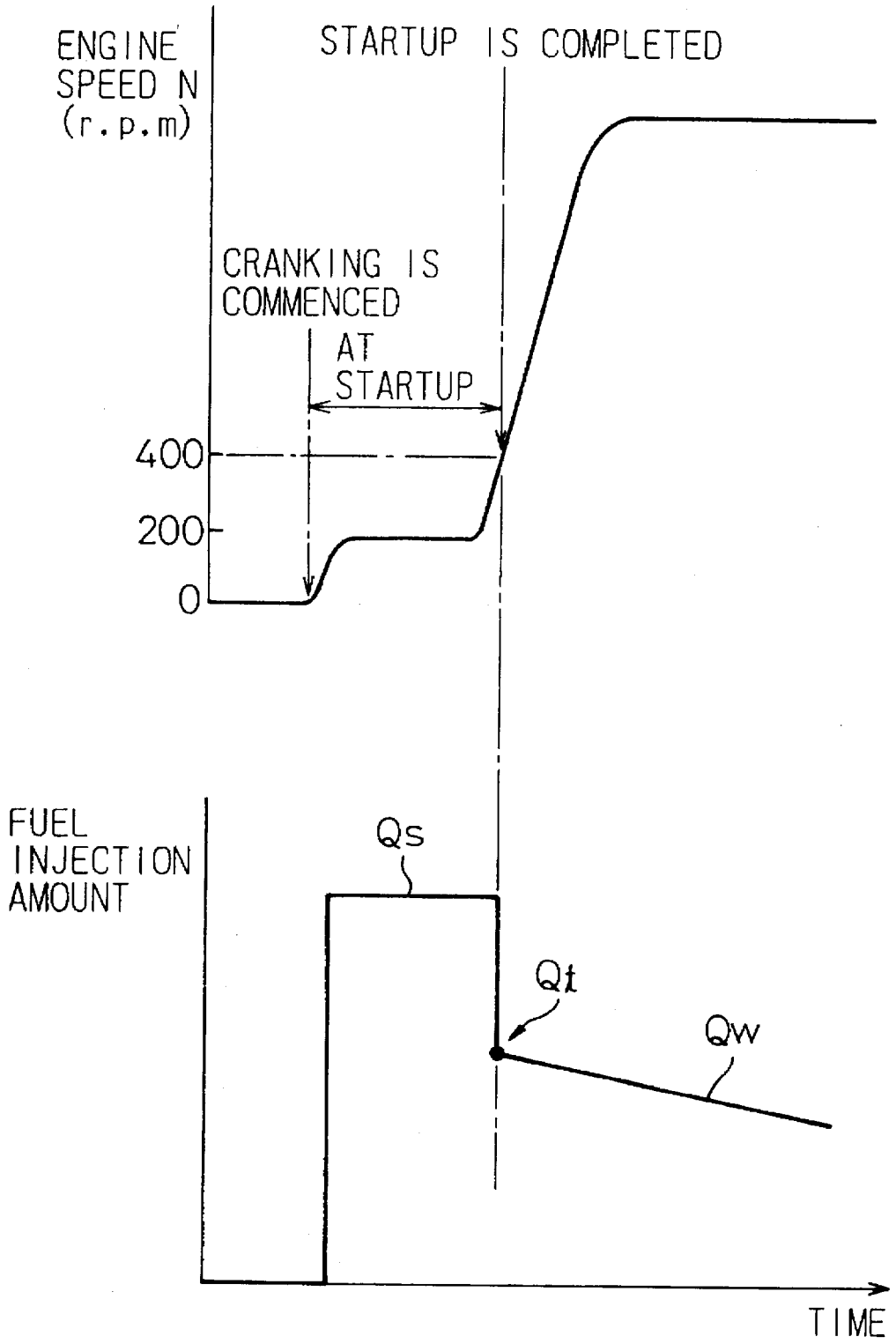
FIG. 2 is a view of the change of an engine speed N and a fuel injection amount during the startup of the engine.

FIG. 2 shows a graph of engine speed versus time and a graph of the amount of fuel being injected into each cylinder versus time during the startup of the engine which has been conventionally generally adopted. As shown in FIG. 2, a little after the cranking is commenced, the engine speed N abruptly rises and the engine begins to operate on its own. The point of time when the engine begins to operate on its own in this way is referred to as the completion of the startup. Usually it is decided that the startup is completed when the engine speed N reaches approximately 400 rpm. The period from when the cranking is commenced to when the startup is completed is usually referred to as the engine startup time. Accordingly, also in the present application, the period from when the cranking is commenced to when the startup is completed is referred to as the startup time.

Figure 3A:
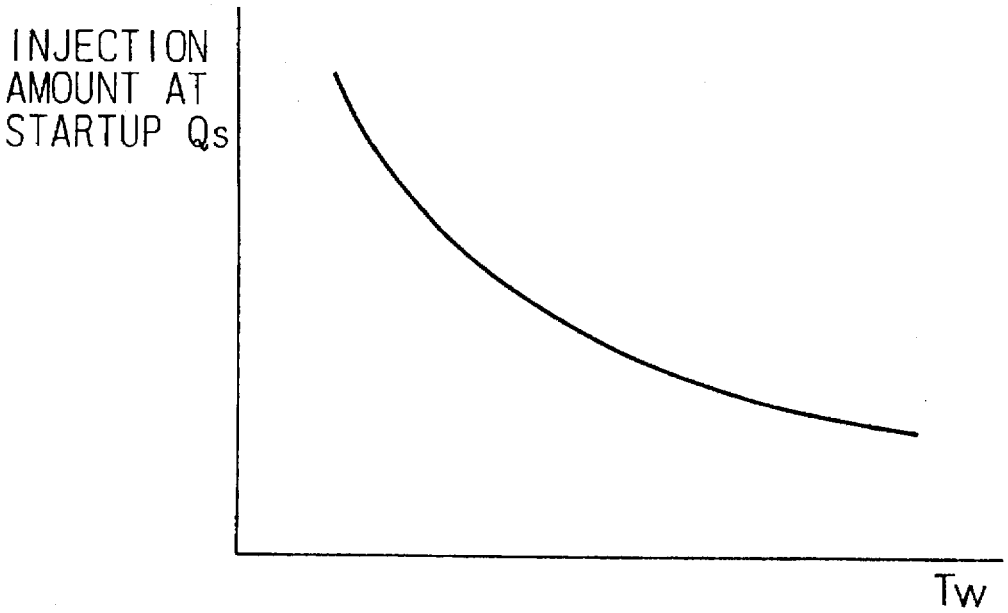
FIGS. 3A and 3B are graphs of an injection amount Qs during the startup and an incremental coefficient K.

In FIG. 2, as indicated by Qs, the fuel injection amount is greatly increased during the startup of the engine. This required amount of injection during the startup (hereinafter, referred to as a startup time injection amount) Qs is a function of the engine cooling water temperature Tw. The lower the engine cooling water temperature Tw, the more the startup time injection amount Qs is increased as shown in FIG. 3A. Subsequently, when the startup of the engine is completed, the fuel amount Qt which is first injected at the cylinders thereafter (hereinafter referred to as the post-start injection amount) is greatly reduced with respect to the startup time injection amount Qs as shown in FIG. 2. This post-start injection amount Qt is calculated by multiplying for example a basic injection time TP by an incremental coefficient K (>1.0) (Qt=TP·K).

Figure 3B:
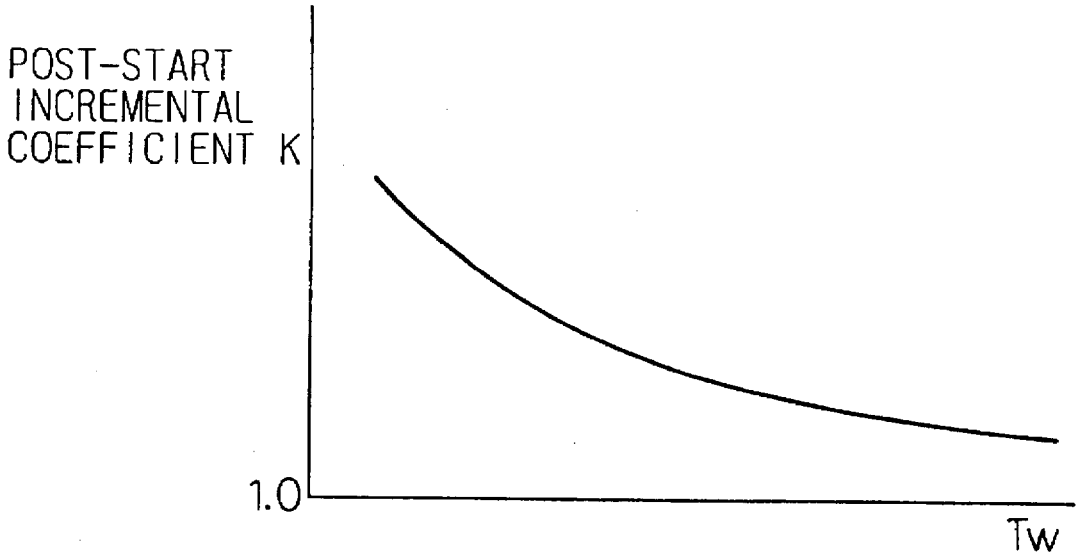

Here, the basic injection time TP is the fuel injection time necessary for bringing the air-fuel ratio to the stoichiometric air-fuel ratio and is preliminarily stored in the ROM 12 in the form of a map as a function of the absolute pressure in the surge tank 3 and the engine speed. On the other hand, the post-start incremental coefficient K is a function of the engine cooling water temperature Tw as shown in FIG. 3B. The lower the engine cooling water temperature Tw, the larger it becomes. After fuel is injected in the injection amount Qt to the cylinders after the completion of the startup of the engine, the fuel injection amount is gradually reduced along with the elapse of time as indicated by Qw in FIG. 2. This is the control of the amount of fuel injection which has been conventionally generally adopted.

The present invention is the same as the related art in that the startup time injection amount Qs shown in FIG. 3A is used as the injection amount during the startup of engine as well, and the incremental coefficient K shown in FIG. 3B is used as the incremental coefficient after the start. In the related art, however, during the period from the start of the cranking to when the startup is completed, the fuel was successively injected from the fuel injectors 6 whenever the injection timing arrived. In contrast, in the present invention, the fuel injection from some of the fuel injectors 6 is stopped for a period from the start of the cranking to when the startup is completed. This is the difference between the related art and the present invention. It will be explained referring to FIG. 4 and FIG. 5.

FIG. 4 shows various injection patterns A, B, C, D, E, and F for use during the startup of the engine. Note that, in FIG. 4, 1 to 8 show the order of arrival of the injection time, the mark o indicates a case where the injection is carried out, and the mark x indicates a case where the injection is reduced or stopped, i.e. reduced to zero. Accordingly, when considering for example the injection pattern F, the fuel injection is carried out in a cylinder having an order of injection timing of 1, that is, in a cylinder for which the injection timing comes first during the startup of the engine, and the fuel injection is stopped in a cylinder having an order of injection timing of 2, that is, in a cylinder for which the injection timing comes second during the startup of the engine. Namely, in the injection pattern F, the fuel injection is carried out in cylinders for which the injection timing comes first, third, and sixth in order during the startup of the engine. The injection amounts in these fuel injections are made the startup time injection amount Qs shown in FIG. 3A. Contrary to this, the fuel injection is stopped in the cylinders for which the injection timing comes second, fourth, fifth, seventh, and eighth in order during the startup of the engine.

The injection pattern is selected based on at least one sensed condition or state that affects the ease with which the engine is started. The startup injection patterns A–F decrease the number of cylinders into which a full amount of fuel is injected and, consequently, lower the number of cylinders into which a reduced amount of fuel is injected as the sensed cooling water temperature increases, thus, indicating that the engine is easier to start. The injection pattern A is a pattern used when the engine is in the state where the startup is most difficult because the cooling water temperature is low. At this time, the fuel injection is carried out in all cylinders whenever the injection timing comes. Contrary to this, the pattern F is a pattern used in a state where the engine most easily starts because the cooling water temperature is relatively high. At this time, as mentioned above, the fuel injection is carried out only for three cylinders among eight cylinders. For the remaining injection patterns B, C, D, and E, the patterns are used in the order from B, C, D, and E as the engine becomes easier to start.

As seen from FIG. 4, the number of the cylinders that have a reduced amount of fuel being injected is increased one by one from the injection pattern of A toward the injection pattern of F. A cylinder into which fuel injection is stopped, for which the injection timing comes in any order in the respective injection patterns B to F, is preliminarily determined based on experiments so that the engine can reliably start even if the fuel injection is stopped in this way. Note that, as seen from FIG. 4, the fuel injection is carried out without fail in the cylinder for which the injection timing comes first for all of the injection patterns A to F. This is done so as to complete the startup of the engine as soon as possible after the commencement of the cranking.

The injection patterns A to F are determined based on the ease of the startup of the engine as indicated by the sensed condition or state, that is, based on the states of the engine exerting an influence upon the ease of startup of the engine. As examples of values representing the states of the engine exerting an influence upon the startup of the engine, there exist not only the engine cooling water temperature, but also the fuel temperature, intake temperature, humidity, battery voltage, etc. The injection patterns A to F are determined based on these representative values. Note that, FIG. 4 shows the relationship between the engine cooling water temperature and the injection pattern. It is seen that as the cooling water temperature at the startup of the engine is higher, the injection pattern changes from A to F.

The relationship between the cooling water temperature and the ease with which the engine is started is generally known. As the cooling water temperature decreases, the ease with which the engine starts decreases. In a similar, generally known matter, other conditions or states also affect the ease with which an engine is started.

Figure 5:
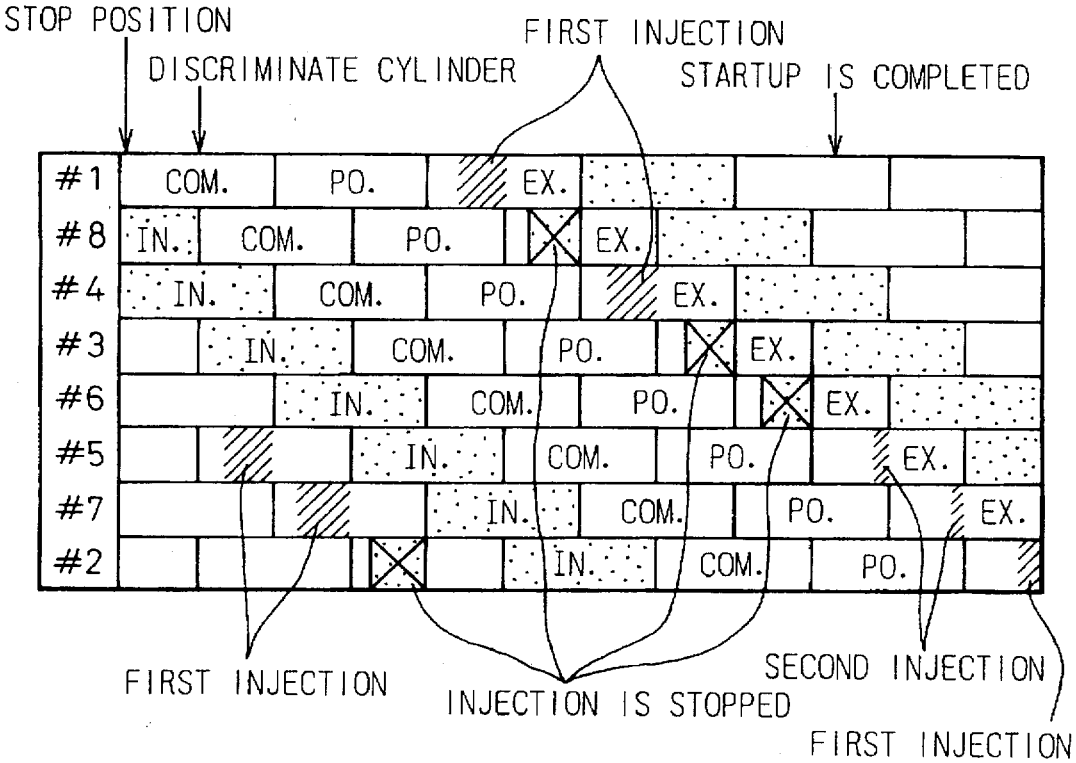
FIG. 5 is a view of strokes and injection timings of the cylinders.

FIG. 5 shows the strokes of the cylinders of the 8-cylinder V-engine shown in FIG. 1. In FIG. 5, "IN" indicates the intake stroke, "COM" indicates a compression stroke, "PO" indicates a power stroke, and "EX" indicates an exhaust stroke, respectively. Further, in FIG. 5, #1 to #8 indicate the cylinder numbers. Accordingly it is seen that the ignition order of the 8-cylinder V-engine shown in FIG. 1 is 1-8-4-3-6-5-7-2. Further, FIG. 5 shows a case where the injection is made with the injection pattern E of FIG. 4. Further it is seen from FIG. 5 that the fuel injection timings to the cylinders are set during the exhaust stroke of the corresponding cylinders.

FIG. 5 shows a case where the cranking is commenced so as to startup the engine when the engine is at the position indicated by an arrow. After the cranking is commenced, the cylinder for which the injection timing comes first is discriminated based on the output signal of the cylinder discriminating sensor 23 (FIG. 1). In the case of FIG. 5, the cylinder for which the injection timing comes first is the fifth cylinder. When the injection timing of the fifth cylinder comes, the first fuel injection is carried out from the fuel injector 6 of the fifth cylinder. The injection amount at this time is the startup time injection amount Qs shown in FIG. 3A. The cylinder for which the injection timing comes next is the seventh cylinder. When the injection timing of the seventh cylinder comes, the first fuel injection is carried out from the fuel injector 6 of the seventh cylinder with respect to the seventh cylinder. Also the injection amount at this time is the startup time injection amount Qs. The cylinder for which the injection timing comes next is the second cylinder. The fuel injection to this cylinder is stopped.

The cylinder for which the injection timing comes next is the first cylinder. When the injection timing of the first cylinder comes, the first fuel injection is carried out from the fuel injector 6 of the first cylinder with respect to the first cylinder. Also the injection amount at this time is the startup time injection amount Qs. The cylinder for which the injection timing comes next is the eighth cylinder. The fuel injection to this cylinder is stopped. The cylinder for which the injection timing comes next is the fourth cylinder. When the injection timing of the fourth cylinder comes, the first fuel injection is carried out from the fuel injector 6 of the fourth cylinder with respect to the fourth cylinder. Also the injection amount at this time is the startup time injection amount Qs. The cylinder for which the injection timing comes next is the third cylinder. The fuel injection to this cylinder is stopped. The cylinder for which the injection timing comes next is the sixth cylinder The fuel injection to this cylinder is stopped as well.

At the first injection timing with respect to the third cylinder, that is, about when the seventh injection timing comes, the fifth cylinder for which the fuel injection is carried out first after the commencement of cranking enters into the power stroke, then the seventh cylinder enters into the power stroke. As a result, the engine speed starts to rise, and thus the startup is completed. Subsequently, the second fuel injection is carried out with respect to the fifth cylinder. At this time, the startup of the engine has been completed, and accordingly the injection amount at this time becomes the post-start injection amount Qt (=TP·K) obtained by multiplying the basic fuel injection time TP by the incremental coefficient K shown in FIG. 3B. Subsequently, the second fuel injection is carried out with respect to the seventh cylinder. Also the injection amount at this time becomes the post-start injection amount Qt (=TP·K) obtained by multiplying the basic fuel injection time TP by the incremental coefficient K shown in FIG. 3B.

Figure 6:
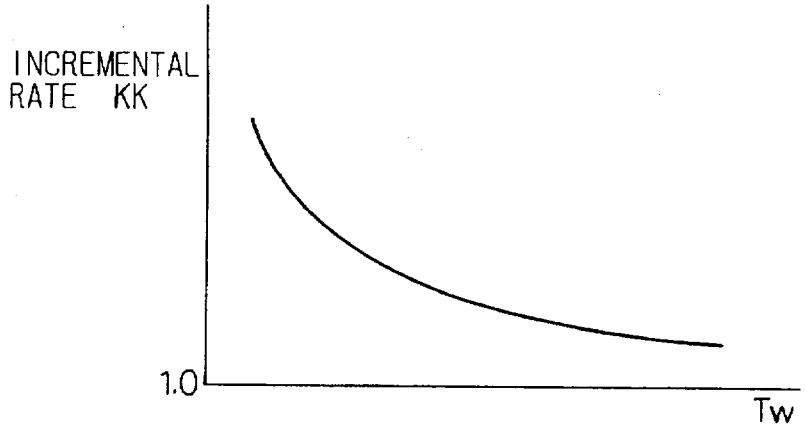
FIG. 6 is a graph of an incremental rate KK.

Subsequently, the fuel injection is carried out with respect to the second cylinder. At this time, the first fuel injection is made with respect to the second cylinder. When the first fuel injection is carried out, part of the injected fuel is used for wetting the inner wall of the intake port and is not supplied into the combustion chamber. Accordingly the injection amount at this time is increased by multiplying the post-start injection amount Qt (=TP·K) by the incremental rate KK (>1.0). This incremental rate KK is determined based on the states of the engine exerting an influence upon the ease of startup of the engine. Also in this case, as an example of the values representing the states of the engine exerting an influence upon the ease of startup of the engine, there exist the engine cooling water temperature first, the fuel temperature, intake temperature, humidity, battery voltage, etc. FIG. 6 shows the relationship between the engine cooling water temperature Tw among these representative values and the incremental rate KK. As shown in FIG. 6, the lower the engine cooling water temperature Tw, the larger the incremental rate KK.

In this way, the first injection amount after the completion of startup of the engine becomes Qt (=TP·K) as in the fifth cylinder and the seventh cylinder, or becomes Qt·KK (=TP·K·KK) as in the second cylinder. The injection amount after this is defined as Qw shown in FIG. 2 irrespective of the first injection amount after the completion of the startup of the engine.

Figure 7:
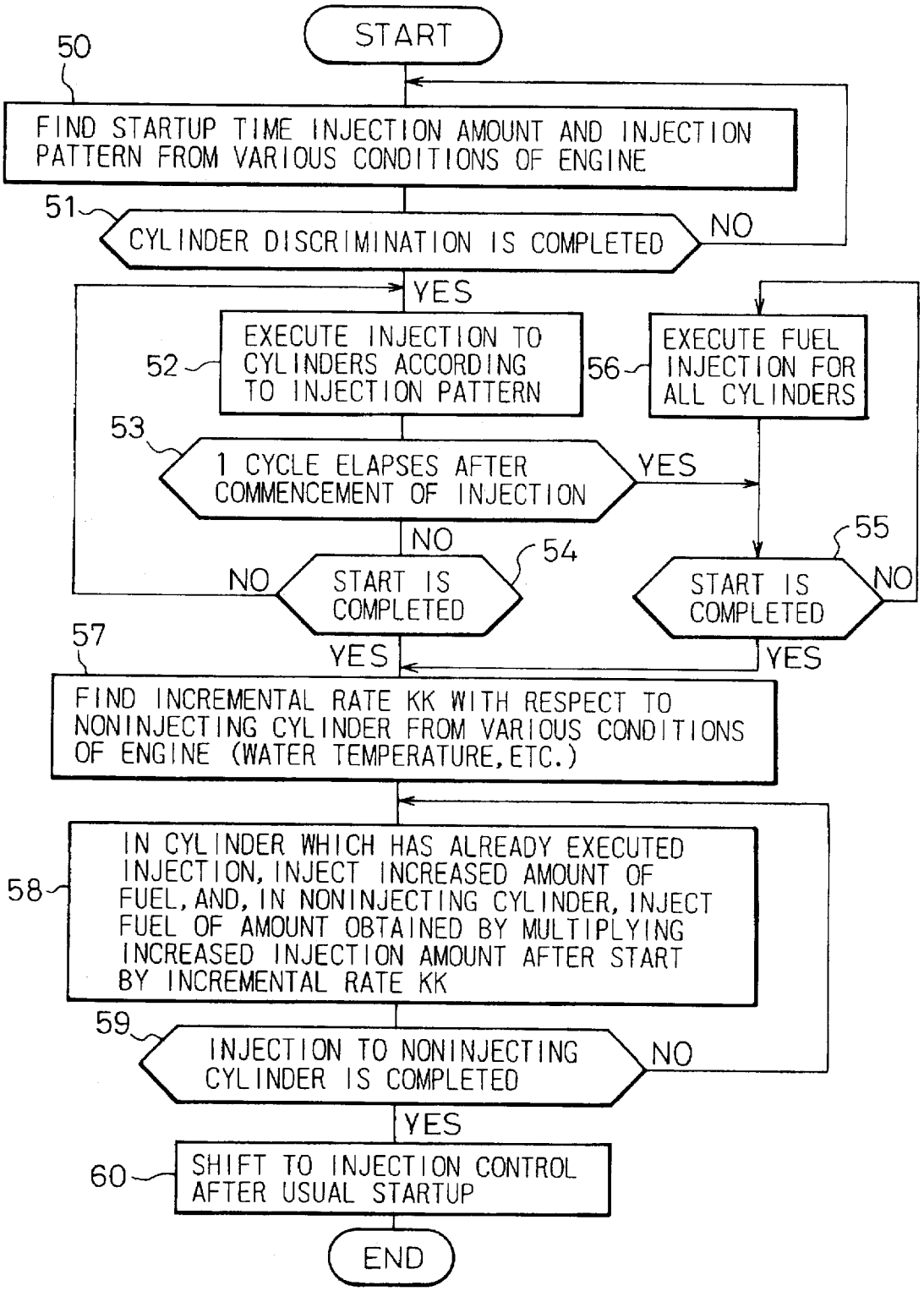
FIG. 7 is a flowchart for the fuel injection control during the startup of engine and immediately after the start.

FIG. 7 shows a control routine of the fuel injection at the startup of the engine and immediately after the startup.

Referring to FIG. 7, first of all, at step 50, the startup time injection amount Qs is calculated from the relationship shown in FIG. 3A based on the engine cooling water temperature Tw. Further, each of the injection patterns of A to F is determined based on the engine cooling water temperature and other values which represent the states of the engine exerting an influence upon the startup of the engine. Subsequently, at step 51, it is determined whether or not the cylinder discrimination action to be carried out based on the output signal of the cylinder discriminating sensor 23 is completed. When the cylinder discrimination action has not been completed, the processing routine returns to step 50, and when the cylinder discrimination action is completed, the processing routine goes to step 52.

At step 52, the fuel injection to the cylinders is commenced according to the injection pattern. Subsequently, at step 53, it is determined whether or not one cycle has elapsed after the injection is commenced, that is, whether or not the crank angle has passed 720 degrees after the injection is commenced. When one cycle has not elapsed after the injection is commenced, the processing routine goes to step 54, at which it is determined whether or not the startup of the engine is completed, that is, whether or not the engine speed exceeds for example 400 rpm. When the startup of the engine has not been completed, the processing routine returns to step 52, and when the startup of the engine has been completed, the processing routine goes to step 57. Usually, the startup of the engine is completed after the injection is commenced and before one cycle elapses. Accordingly, usually, the processing routine passes step 53 and step 54 and goes to step 57.

At step 57, the incremental rate KK is calculated from the values representing the states of the engine exerting an influence upon the startup of the engine, for example, the engine cooling water temperature. Subsequently, at step 58, fuel of the post-start injection amount Qt (=TP·K) is injected to the cylinder for which the fuel injection was carried out during the startup of the engine, while fuel of an amount represented by QT·KK (=TP·K·KK) is injected to the cylinder for which the fuel injection was stopped during the startup of the engine. Subsequently, at step 59, it is determined whether or not the first fuel injection to all cylinders for which the fuel injection was stopped at the startup of the engine is completed. When it is completed, the processing routine goes to step 60, where the processing routine is shifted to the post-start injection control indicated by Qw of FIG. 2.

As mentioned before, usually the startup of the engine is completed after the injection is commenced and before one cycle elapses. Where the startup of the engine has not been completed even if one cycle has elapsed after the injection is commenced, the processing routine goes from step 53 to step 55. At step 55, it is determined whether or not the startup of the engine has been completed. When the startup of the engine has not been completed, the processing routine passes step 56 and returns to step 55 again. At step 56, fuel in an amount of about 80 percent of the startup time injection amount Qs shown in FIG. 3A is injected to the cylinder for which the fuel injection has been already carried out, and fuel of the startup time injection amount Qs shown in FIG. 3A is injected with respect to the cylinder for which the fuel injection has not yet been carried out. Subsequently, when the startup of the engine is completed, the processing routine goes from step 55 to step 57.

As seen from FIG. 5, the injection timing comes seven times after the commencement of cranking and before the first injected fuel causes the explosive combustion, and the injection timing comes seven or more times before the startup of the engine is completed. Conventionally, fuel of the startup time injection amount Qs shown in FIG. 3A is injected whenever the injection timing comes after the commencement of cranking before the startup of the engine is completed. As a result, a large amount of unburned hydrocarbons is discharged. Further, when the fuel of the startup time injection amount Qs is injected whenever the injection timing comes as in the related art, the engine speed abruptly rises when the startup of the engine is completed and as a result the engine speed temporarily becomes extremely high.

In order to start the engine, however, it is not always necessary to inject fuel of the startup time injection amount Qs whenever the injection timing comes at the startup of an engine in this way. Accordingly, in the present invention, the fuel injection to part of cylinders is stopped at the startup of the engine. When the fuel injection to part of the cylinders is stopped at the startup of the engine in this way, the unburned hydrocarbons discharged from the engine are reduced, and further the engine speed no longer temporarily becomes extremely high.

In the embodiment mentioned heretofore, the fuel injection to part of the cylinders was stopped at the startup of the engine. However, it is also possible to reduce the fuel injection to part of the cylinders, not to stop the fuel injection to part of the cylinders. Namely, it is also possible to reduce the injection amount for the cylinder of the injection timing indicated by the mark x in FIG. 4 compared with the startup time injection amount Qs. In this case, for example, for the cylinder of the injection timing indicated by the mark x in FIG. 4, fuel in an amount necessary for wetting the inside wall of the intake port can be injected.

While the invention has been described by reference to specific embodiments chosen for purposes of illustration, it should be apparent that numerous modifications could be made thereto by those skilled in the art without departing from the basic concept and scope of the invention.

I claim:

1. A fuel injection control device of a multi-cylinder engine, comprising:

at least one sensor for monitoring a condition that affects the ease with which the engine is started and generating a sensor output signal;

a processor responsive to the at least one sensor output signal to generate a fuel injection signal indicating at least one first cylinder into which a full amount of fuel is to be injected and at least one second cylinder into which a reduced amount of fuel is to be injected, said first and second cylinders being selected to provide ease of starting; and a fuel injection controller responsive to said fuel injection signal to inject the full amount of fuel into the at least one first cylinder and to inject the reduced amount of fuel into the at least one second cylinder.

2. The fuel injection control device of claim 1, wherein one of the at least one first cylinder is the cylinder for which the injection timing comes first among all cylinders during the startup period.

3. The fuel injection control device of claim 1, wherein the ratio of first cylinders to second cylinders decreases as the condition indicates that the engine is easier to start.

4. The fuel injection control device of claim 3, wherein the condition is engine temperature and wherein the ratio of first cylinders to second cylinders decreases as the engine temperature increases.

5. The fuel injection control device of claim 1, wherein the at least one first cylinder comprises all cylinders of the engine when the condition indicates that the engine is the most difficult to start.

6. The fuel injection control device of claim 1, wherein the at least one first cylinder is determined based upon the injection order at the initial starting position of the engine.

7. The fuel injection control device of claim 6, wherein the fuel injection signal is generated prior to starting the engine.

8. The fuel injection control device of a multi-cylinder engine, comprising:

injection cylinder determining means for determining at least one first cylinder into which a required amount of fuel is to be injected and at least one second cylinder into which a reduced amount of fuel is to be injected during the startup of the engine where the ratio of first cylinders to second cylinders is determined based on the states of the engine exerting an influence upon the startup of the engine irrespective of the position of the engine; and injection control means for controlling the injection action of the fuel with respect to the cylinders at the startup of the engine based on the determination by said injection cylinder determining means, wherein said injection cylinder determining means decreases the ratio of first cylinders to second cylinders during the startup of the engine as the state of the engine indicates that the engine is easier to start.

9. A fuel injection control device of a multi-cylinder engine, comprising:

injection cylinder determining means for determining at least one first cylinder into which a required amount of fuel is to be injected and at least one second cylinder into which a reduced amount of fuel is to be injected during the startup of the engine, where the ratio of first cylinders to second cylinders is determined based on the states of the engine exerting an influence upon the startup of the engine irrespective of the position of the engine; and injection control means for controlling the injection action of the fuel with respect to the cylinders at the startup of the engine based on the determination by said injection cylinder determining means, wherein fuel of a predetermined post-start amount smaller than the required amount is individually injected to the at least one first cylinder immediately after the startup of the engine is completed; and said predetermined post-start amount with respect to the at least one second cylinder is increased compared with said predetermined post-start amount to the at least one first cylinder.

10. A fuel injection control device of a multi-cylinder engine according to claim 9, wherein the incremental rate of said predetermined post-start amount is changed based on a state of the engine exerting an influence upon the startup of the engine.

11. A fuel injection control device of a multi-cylinder engine according to claim 10, wherein the lower the engine temperature, the larger the incremental rate of the post-start amount.

12. A fuel injection control device of a multi-cylinder engine, comprising:

injection cylinder determining means for determining at least one first cylinder into which a required amount of fuel is to be injected and at least one second cylinder into which a reduced amount of fuel is to be injected during the startup of the engine, where the ratio of first cylinders to second cylinders is determined based on the states of the engine exerting an influence upon the startup of the engine irrespective of the position of the engine;

injection control means for controlling the injection action of the fuel with respect to the cylinders at the startup of the engine based on the determination by said injection cylinder determining means;

wherein judgment means is provided for judging whether or not the startup of the engine is completed before a predetermined period has elapsed after the commencement of injection at the startup of the engine; and said injection cylinder determining means performs the fuel injection with respect to all cylinders when the startup of the engine has not been completed before the predetermined period has elapsed after the commencement of injection.

13. A fuel injection control device of a multi-cylinder engine according to claim 12, wherein said predetermined period is one cycle of the engine.

* * * * *